United States Patent [19]

Mills

[11] Patent Number: 4,860,940

[45] Date of Patent: Aug. 29, 1989

[54] METHOD OF MAKING A POST SUPPORT

[75] Inventor: Derek J. Mills, Wales, United Kingdom

[73] Assignee: Metpost Ltd., Cardiff, United Kingdom

[21] Appl. No.: 225,005

[22] Filed: Jul. 27, 1988

[30] Foreign Application Priority Data

Jul. 27, 1987 [GB] United Kingdom ..... 8717737

[51] Int. Cl.[4] ..... B23K 31/02

[52] U.S. Cl. ..... 228/173.4; 29/445

[58] Field of Search ..... 29/150, 155 R, 445; 52/155, 165, 298; 228/142, 144, 145, 146, 173.4; 248/156, 545

[56] References Cited

U.S. PATENT DOCUMENTS

| | | | |
|---|---|---|---|
| D. 29,550 | 10/1898 | Patterson | 52/165 X |
| 4,588,157 | 5/1986 | Mills | 248/545 |
| 4,644,713 | 2/1987 | Lehman | 52/298 X |

FOREIGN PATENT DOCUMENTS

| | | | |
|---|---|---|---|
| 470829 | 1/1951 | Canada | 52/155 |
| 2101651 | 1/1983 | United Kingdom . | |
| 2152550 | 8/1985 | United Kingdom . | |

*Primary Examiner*—Howard N. Goldberg
*Assistant Examiner*—Andrew E. Rawlins
*Attorney, Agent, or Firm*—Scully, Scott, Murphy & Presser

[57] ABSTRACT

A post support made of metal sheet or plate comprises a box section of rectangular cross section for receiving a post and an elongate ground engaging portion welded thereto, the ground engaging portion is of cruciform section and the box is formed with slots in its base defining an X or Y cross corresponding to the section of the ground engaging portion. Integral portions of the material of the base of the box section are bent downwardly so that the edges of the slots are bounded by dependent flanges and the ground engaging portion is received between the flanges and located in the slot and welded at least along the edge of the flanges. Methods for forming the post support are also described.

2 Claims, 2 Drawing Sheets

METHOD OF MAKING A POST SUPPORT

This invention relates to post supports and more particularly to a post support of metal and comprising a box section of rectangular cross section for receiving a post and an elongate ground engaging portion welded to the base of the box section and which can be driven into the ground to hold the post support steady, the ground engaging portion being of cruciform section, which may be an X or Y cross.

GB-A-2152550 discloses a method for making such a post support in which the box section is formed with slot in its base of dimensions appropriate closely to engage with one end of the cruciform ground engaging portion and the ground engaging portion is introduced into the slots and welded to attach the ground engaging portion rigidly to the box section. The box section may be made from a single blank of metal sheet or plate bent to form a rectangular section sleeve with a single longitudinal weld along one side or edge or from two, three or four pieces with appropriate longitudinal welds. However many pieces are used to form the box section an edge portion of the blank is turned inwardly to extend perpendicularly of the wall of the box section to form the base of the box section. In order that slots are formed in the base of the box section trapezoidal sections are removed from one edge of the blank or blanks from which the box section is made.

This invention is based on the observation that at least some of the trapezoidal sections of metal can be retained and bent substantially perpendicularly to the plane of the blank so that when the box section is assembled from the blank or blanks, material in the trapezoidal sections form triangular dependant flanges bounding the slots. An end of the ground engaging portion can be introduced between the flanges into the slot and welded into the slot at least along the edge of the flanges.

This arrangement gives a very much stronger post support partly because of the increased length of the weld between the box section and the ground engaging portion and partly because the flanges provided increased resistance to a bending moment applied to the box section and the ground engaging portion.

The invention therefore provides a post support made of metal sheet or plate and comprising a box section of rectangular cross section which is open at one end for receiving a post and at least partially closed at its other end and an elongate ground engaging portion welded thereto, the ground engaging portion being of cruciform section and the box section being formed with a slot in its base defining an X or Y cross corresponding to the section of the ground engaging portion, wherein integral portions of the material of the base of the box are bent downwardly so that the edges of the slots are bounded by dependent flanges, an end of the ground engaging portion being received between the flanges and located in the slot and welded to the box section.

The invention also provides a method of making a post support which comprises forming a box section which is open at one end and at least partially closed at the other end and attaching a cruciform ground engaging portion by welding to the at least partially closed end of the box section wherein the box section is formed from a blank or blanks and the base of the box section is formed by bending portions of the blank or blanks inwardly and by bending portions of said in-turned portions away from the open end of the box section thereby to form in the base of the box section a cruciform slot bounded on both sides by dependant flanges extending away from the open end of the box section and welding one end of the ground engaging portion of corresponding cruciform section into the slot between the dependent flanges.

The box section can be assembled from a single blank or from two or more identical or different blanks, as desired for ease of manufacture. This will depend to a large extent on the shape and positioning of the slot in the base of the box section and the position in which welds are to be produced in the formation of the box section.

The order of forming bends in the blank or blanks to form the box section (where appropriate), the base of the box section and the dependent flanges can also be chosen as desired for ease of manufacture.

In the simplest case, where the slot is an X-shaped cross arranged along the diagonals of a rectangular box section, a single blank can be used with a single longitudinal weld in one side or edge of the box section. In order that the dependent flanges are spaced apart to define the slot and to receive the end of the ground engaging portion, it will normally be necessary to remove a thin strip of material from between the portions of the blank that are to form two adjacent flanges.

For other shapes or orientations of the slot, and particularly where the slot does not extend into any corner of the box section, it will normally be desirable to remove triangular portions of the blank, to enable the corners of a rectangular box section to be formed without formation of a double thickness of material. This is particularly the case where the slot is an X-shaped cross that does not extend diagonally of a rectangular box section or where the slot is a Y-shaped cross. In such cases the shape of the blank or blanks may need to be other than substantially rectangular to provide material that can be used to form the dependent flanges.

In an alternative method of manufacture the box section can be formed as an open ended sleeve with appropriately positioned longitudinal slits at one end. One end of the cruciform ground engaging portion is inserted into the sleeve from the end with the slits and the base of the box section and the flanges are then formed in a single operation by pressing the material of the wall of the sleeve at said one end inwardly so that the ground engaging portion serves as a forming tool for forming the flanges.

The invention will now be described in greater detail by way of example with reference to the drawings in which.

Figure 3:
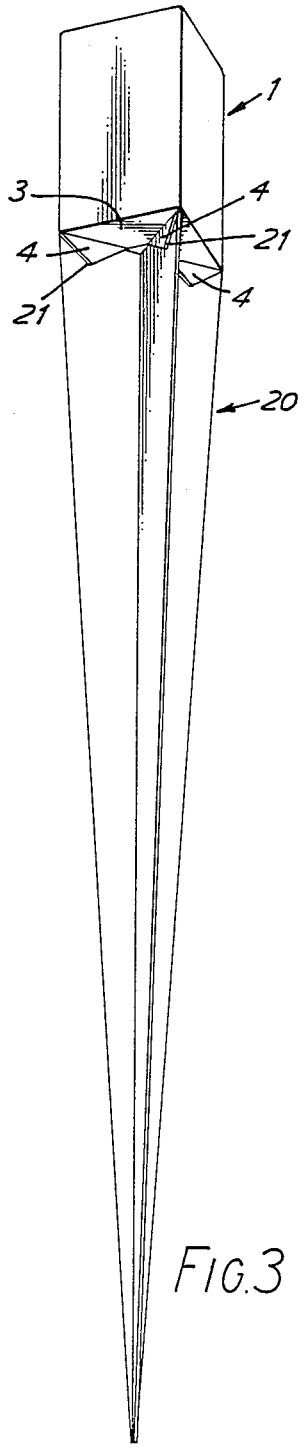
FIG. 3 shows a post support incorporating the box section of FIG. 1.
Figure 5:
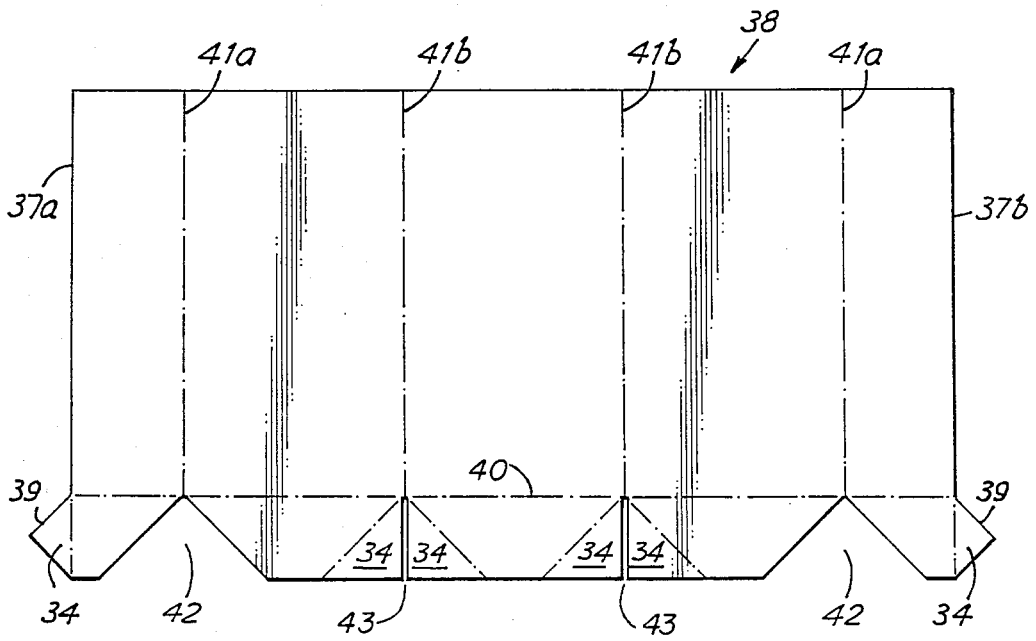

and FIG. 5 shows one form of blank that can be used to form the box section of FIG. 3.

Figure 1:
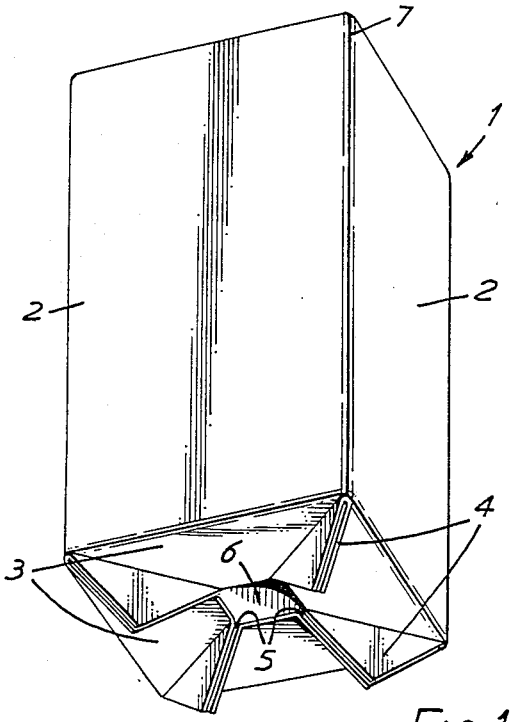
FIG. 1 shows a first form of box section.

With regard to FIG. 1, the first form of box section 1 is of substantially square section and is formed for example of $\frac{1}{8}$ inch (3 mm) mild steel sheet. The box section comprises walls 2, a base 3 formed by turning a portion of the sheet at the end of the walls 2 inwardly and dependant flanges 4 defining an X-shaped slot 5. The dependant flanges 4 are formed by bending downwardly a portion of the material forming the base 3 of the box. A square aperture 6 is left centrally of the base of the box.

The size of the aperture 6 will, of course, depend on the width of the portion of material that is turned inwardly to form the base 3 and need not be present but the width of this inturned portion must not, of course, exceed one half of the width of a wall 2.

Figure 2:
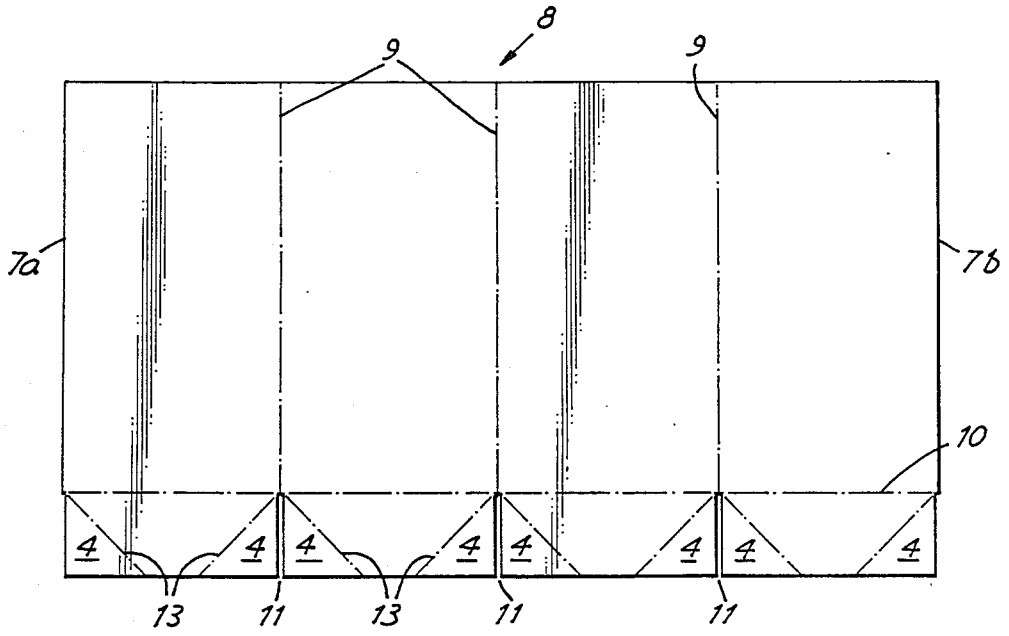
FIG. 2 shows one form of blank that can be used to form the box section of FIG. 1.

As shown in FIG. 2 the box section 1 of FIG. 1 is formed from a single blank of material with a single weld along one edge at 7. The blank 8 is a substantially rectangular blank of, for example, mild steel and is, for producing a box section that is substantially 3 inches square and 6 inches high, of dimensions approximately 12 inches by 8 inches. The blank 8 can be bent around dotted lines 9 to bring the two edges 7*a*, 7*b* together so that the longitudinal weld 7 can be formed along the joining edge. The blank can also be bent along line 10 which is positioned approximately 2 inches from the lower end of the blank to partially close the end of the box section. The bends along lines 9 and 10 are both made at right angles and are in the same direction relative to the plane of the blank. At the lower end of the blank and extending along the lines 9 up to line 10 are slots 11 such that when triangular portions 4 are bent along lines 13, at right angles to the plane of the blank, in the opposite direction of bending to the bends along lines 9 and 10 the assembled box has dependant flanges 4 spaced by the width of slots 11.

In assembly of the box section the order of bending is immaterial provided only that the bends along lines 9 and 10 are not both completed before the bends along lines 13.

FIG. 3 shows a post support incorporating the box section 1 of FIG. 1. As shown in FIG. 3, a tapering ground engaging portion 20 of 'X'-shaped cross-section is introduced into the slot 5 between pairs of flanges 4 and is welded at 21 at least along the edges of the flanges 4. If desired, additional welds can be formed at the junction of the inside of the base 3 of the box section 1 and the top end of the ground engaging portion 20.

Figure 4:
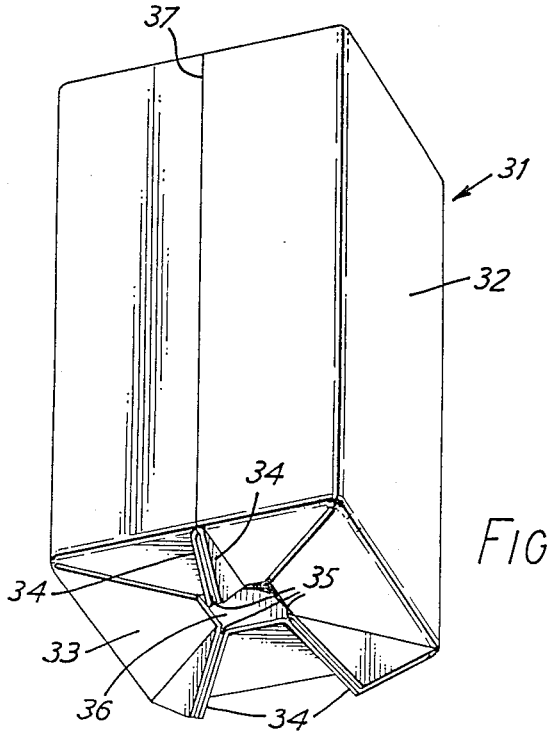
FIG. 4 shows a second form of box section.

With regard to FIG. 4, the second form of box section 31 is also of square section but in this case the slot 35 in the base 33 of the box section is a Y-shaped slot. As described in connection with FIG. 1, the box section 31 comprises walls 32, a base 33 and dependant flanges 34 defining slot 35. A central aperture 36 is left in the base 33. A single weld 37 is formed on the medial line of one wall 32.

FIG. 5 shows a blank 38 for forming the box section 31 of FIG. 4. The blank is substantially rectangular and of the same general dimensions as described in relation to FIG. 2 but has two triangular portions 39 extending downwardly and outwardly at an angle of 45° from a bend line 40 positioned about 2 inches from the lower edge of the blank 38. The blank 38 can be bent about dotted lines 41 to bring edges 37*a* and 38*b* together. Two equilateral triangular portions 42 positioned symetrically about the two outer bend lines 41*a*, extending from bend line 40 to the edge of the blank, are removed to allow the formation of the base 33 of the box section without overlap of material. As shown slots 43, as described in relation to FIG. 2, are formed on the two inner fold lines 41*b*. In this case the edges 37*a* and 37*b* of the blank 38 are welded together along a medial line of wall 32 instead of at a corner of the box section. Apart from this difference, assembly of the box section 1 may be as described in connection with FIGS. 1 and 2.

I claim:

1. A method of making a post support of the type having a box section which is open at one end and at least partially closed at the other end, and a cruciform ground engaging portion welded to the at least partially closed end of the box section, the method comprising the steps of: forming the box section from a blank or blanks, including forming a base of the box section by bending portions of the blank or blanks inwardly and by bending portions of said inturned portions away from the open end of the box section thereby to form in the base of the box section a cruciform slot bounded on both sides by dependent flanges extending away from the open end of the box section; and welding one end of the ground engaging portion of corresponding cruciform section into the slot between the dependent flanges.

2. The method according to claim 1, wherein the step of forming the box section includes forming the box section as an open ended sleeve with longitudinal slits at one end, and inserting the cruciform ground engaging portion into the sleeve from said one end; and the step of forming the base of the box section includes forming the base of the box section and the flanges in a single operation by pressing the material of the wall of the sleeve at said one end inwardly so that the ground engaging portion serves as a forming tool for forming the flanges.

* * * * *